US010803794B2

(12) United States Patent
Cheng

(10) Patent No.: US 10,803,794 B2
(45) Date of Patent: Oct. 13, 2020

(54) PIXEL CIRCUIT AND HIGH-BRIGHTNESS DISPLAY DEVICE

(71) Applicant: AU Optronics Corporation, Hsin-Chu (TW)

(72) Inventor: Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 70 days.

(21) Appl. No.: 16/239,606

(22) Filed: Jan. 4, 2019

(65) Prior Publication Data

US 2020/0074922 A1 Mar. 5, 2020

(30) Foreign Application Priority Data

Sep. 5, 2018 (TW) ..... 107131180 A

(51) Int. Cl.
*G09G 3/3225* (2016.01)
*G09G 3/3291* (2016.01)

(52) U.S. Cl.
CPC ..... *G09G 3/3225* (2013.01); *G09G 3/3291* (2013.01); *G09G 2310/0264* (2013.01); *G09G 2320/0233* (2013.01); *G09G 2320/0626* (2013.01)

(58) Field of Classification Search
CPC ..... G09G 3/3225; G09G 3/3291; G09G 2310/0264; G09G 2320/0233; G09G 2320/0626
USPC ..... 345/690
See application file for complete search history.

(56) References Cited

U.S. PATENT DOCUMENTS

2014/0333512 A1* 11/2014 In ..... G09G 3/3233 345/76

FOREIGN PATENT DOCUMENTS

| | | | |
|---|---|---|---|
| CN | 205282057 U | | 6/2016 |
| CN | 106952617 A | | 7/2017 |
| CN | 107808636 A | | 3/2018 |
| CN | 108320710 A | * | 7/2018 |
| CN | 108320710 A | | 7/2018 |

* cited by examiner

*Primary Examiner* — Mark Edwards
(74) *Attorney, Agent, or Firm* — WPAT, PC

(57) ABSTRACT

A high-brightness display device includes a plurality of pixel circuits and a driving line. The driving line is configured to provide a first data signal and a second data signal to a column of pixel circuits of the plurality of pixel circuits. When the high-brightness display device is operated in a normal mode, the first data signal is a DC signal and the second data signal is an AC signal, and a driving current of a pixel circuit of the column of pixel circuits has a first maximum current value. When the high-brightness display device is operated in a high-brightness mode, the first data signal and the second data signal are both the AC signals, and the driving current of the pixel circuit have a second maximum current value. The second maximum current value is larger than the first maximum current value.

19 Claims, 10 Drawing Sheets

PIXEL CIRCUIT AND HIGH-BRIGHTNESS DISPLAY DEVICE

CROSS-REFERENCE TO RELATED APPLICATION

This application claims priority to Taiwan Application Serial Number 107131180, filed Sep. 5, 2018, which is herein incorporated by reference in its entirety.

BACKGROUND

Field of Invention

The present disclosure relates to a pixel circuit and a high-brightness display device. More particularly, the present disclosure relates to the pixel circuit and the high-brightness display device having brightness adjusting function.

Description of Related Art

The low temperature poly-silicon thin-film transistor (LTPS TFT) has advantages such as high carrier mobility and small size, and thereby the LTPS TFT is suitable for the use of manufacturing the display device with high resolution, slim border, and low power consumption. The excimer laser annealing method is widely used by the display industry to manufacture the poly-silicon thin film of the LTPS TFT. However, since each shot of the excimer laser has different power, different locations of the poly-silicon thin film may have crystal grains having different sizes and quantity. Therefore, the LTPS TSTs at different locations of the display device may have different electrical characteristics. For example, the LTPS TSTs at different locations may have different threshold voltages. In this situation, the display device may suffer from uneven display pictures. In addition, when a user using a wearable device in a high-brightness environment, the wearable device should provide a corresponding high-brightness display mode in order to prevent the situation that the user can not clearly identify the information provided by the display device of the wearable device.

SUMMARY

The disclosure provides a pixel circuit. The pixel circuit comprises a driving transistor, a compensation circuit, a writing circuit, an emission control circuit, a reset circuit, and a light emitting element. The driving transistor comprises a first node, a second node, and a control node, wherein the first node of the driving transistor is coupled with a first node point, and the second node of the driving transistor is coupled with a second node point, and the control node of the driving transistor is coupled with a third node point. The compensation circuit is coupled with the first node point and the third node point, and configured to control the driving transistor to generate a driving current. The writing circuit is configured to receive a first data signal and a second data signal from a driving line, and to selectively provide the first data signal and the second data signal to the compensation circuit, wherein when the compensation circuit receives the first data signal, the compensation circuit renders a first node point voltage of the first node point positively correlated with an absolute value of a threshold voltage of the driving transistor. The emission control circuit is configured to apply a system high voltage to the first node point. The reset circuit is coupled with the second node point and the third node point, and configured to reset a second node point voltage of the second node point and a third node point voltage of the third node point. The light emitting element comprises a first node and a second node, wherein the first node of the light emitting element is configured to receive the driving current, and the second node of the light emitting element is configured to receive a system low voltage.

The disclosure provides a high-brightness display device. The high-brightness display device comprises a plurality of pixel circuits and a driving line. The driving line is configured to provide a first data signal and a second data signal to a column of pixel circuits of the plurality of pixel circuits. When the high-brightness display device is operated in a normal mode, the first data signal is a DC signal and the second data signal is an AC signal, and a driving current of a pixel circuit of the column of pixel circuits has a first maximum current value. When the high-brightness display device is operated in a high-brightness mode, the first data signal and the second data signal are both the AC signals, and the driving current of the pixel circuit have a second maximum current value. The second maximum current value is larger than the first maximum current value.

It is to be understood that both the foregoing general description and the following detailed description are by examples, and are intended to provide further explanation of the disclosure as claimed.

DETAILED DESCRIPTION

Figure 1:
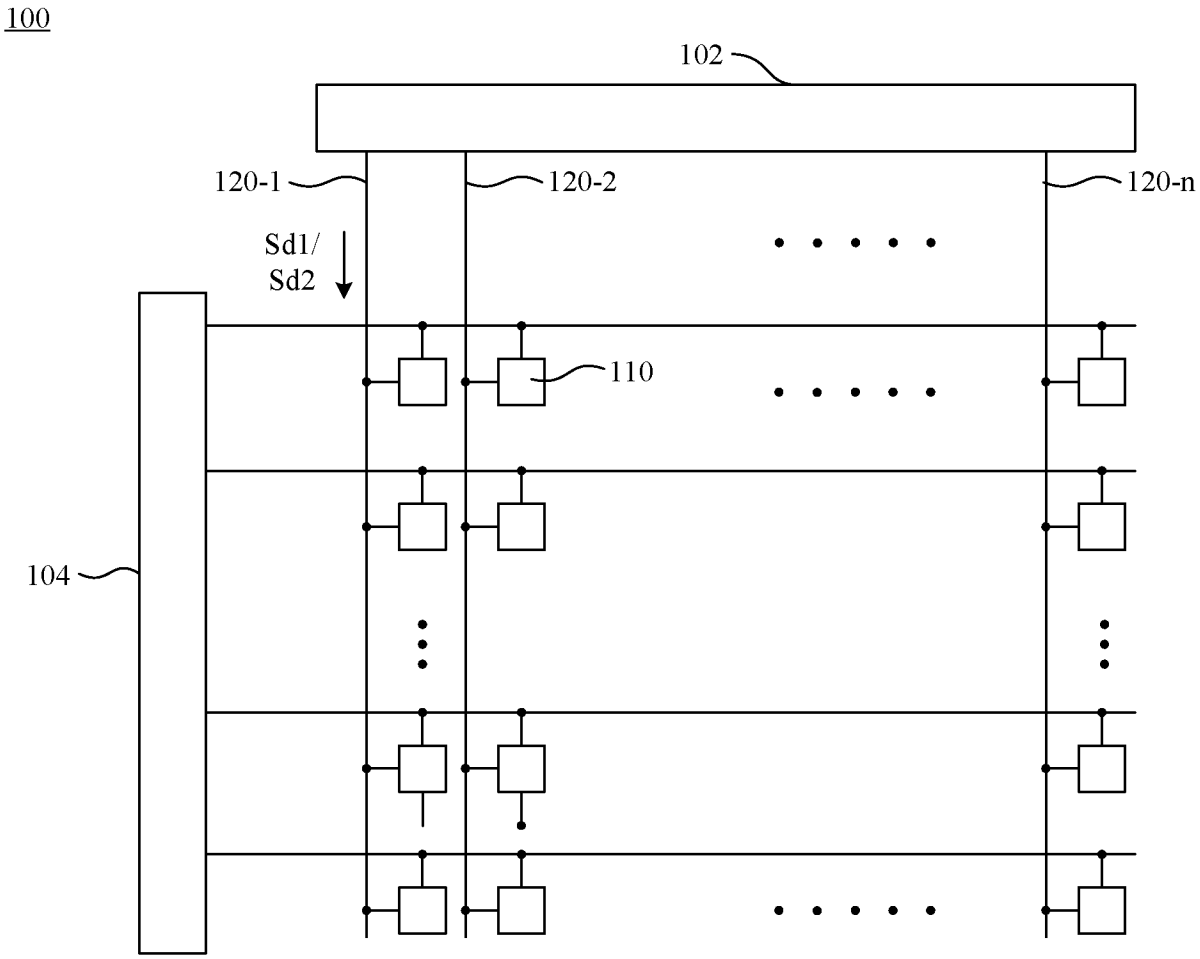
FIG. 1 is a simplified block diagram of a high-brightness display device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified block diagram of a high-brightness display device 100 according to one embodiment of the present disclosure. The high-brightness display device 100 comprises a source driver 102, a gate driver 104, multiple pixel circuits 110, and multiple driving lines **120-1-120-*n*. The driving lines 120-1-120-*n* are coupled with the source driver 102, and each of the driving lines 120-1-120-*n* is configured to provide a first data signal Sd1 and a second data signal Sd2 to a column of pixel circuits 110 of the multiple pixel circuits 110. For the sake of brevity, other functional blocks of the high-brightness display device 100 are not shown in FIG. 1**.

Throughout the specification and drawings, indexes **1-*n* may be used in the reference labels of components for ease of referring to respective components. The use of indexes 1-*n* does not intend to restrict the amount of components to any specific number. In the specification and drawings, if a reference label of a particular component is used without having the index, it means that the reference label is used to refer to any unspecific component of corresponding component group. For example, the reference label 120 is used to refer to any unspecific driving line of the driving lines 120-1-120-*n***.

In this embodiment, the high-brightness display device 100 may be operated in a normal mode or a high-brightness mode. When the high-brightness display device 100 is operated in the normal mode, one of the first control signal Sc1 and the first control signal Sc2 is configured to be a DC signal, and another one is configured to be an AC signal. When the high-brightness display device 100 is operated in the high-brightness mode, the first control signal Sc1 and the first control signal Sc2 are both configured to be AC signal, so as to enlarge the adjustable range of the data signal provided to the pixel circuit 110. Therefore, with respect to the high-brightness mode, the high-brightness display device 100 can provide luminance higher than that of the normal node.

Figure 2:
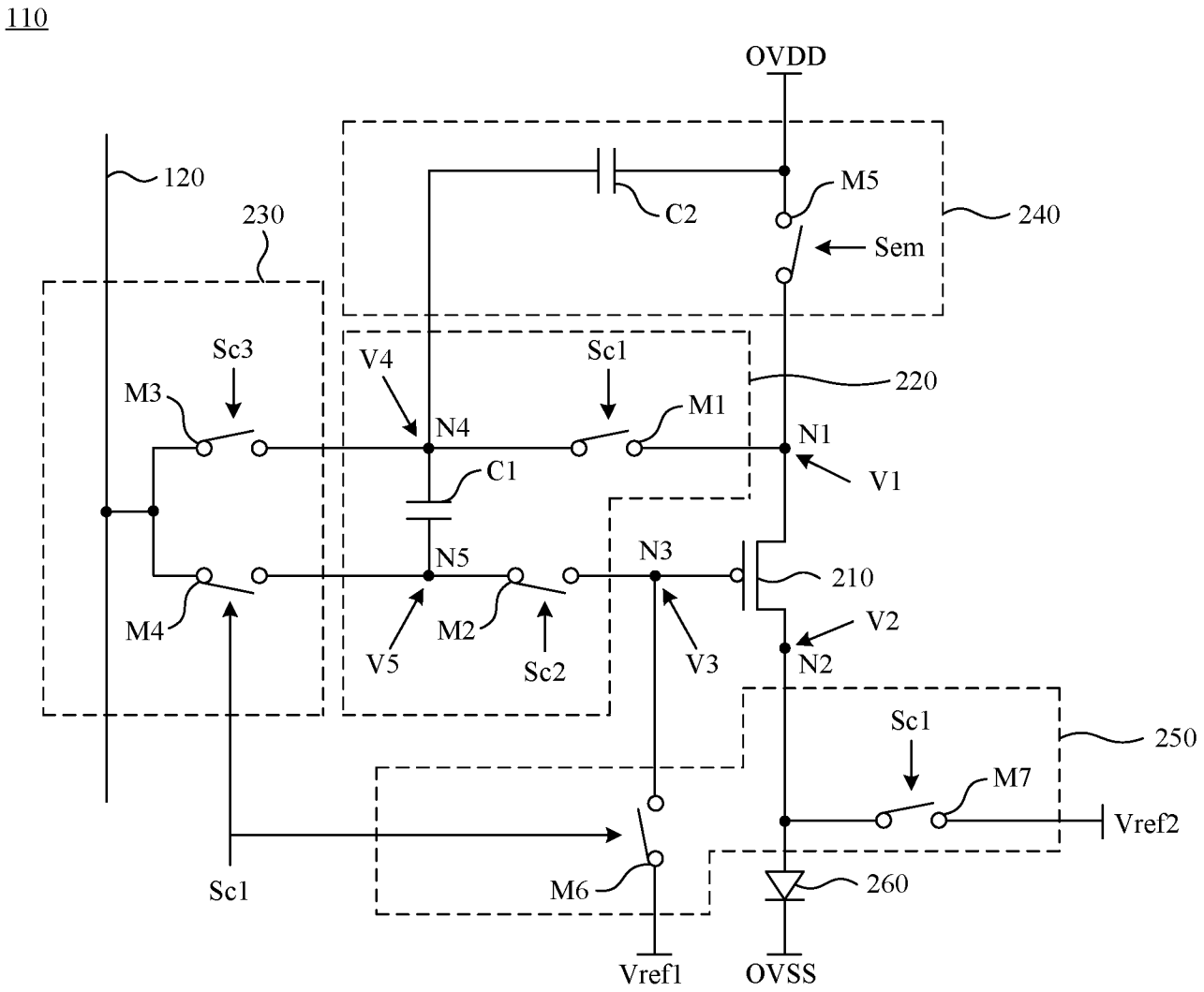
FIG. 2 is a schematic diagram of the pixel circuit of FIG. 1 according to one embodiment of the present disclosure.

FIG. 2 is a schematic diagram of the pixel circuit 110 of FIG. 1 according to one embodiment of the present disclosure. The pixel circuit 110 comprises a driving transistor 210, a compensation circuit 220, a writing circuit 230, an emission control circuit 240, a reset circuit 250, and a light emitting element 260. The driving transistor 210 comprises a first node, a second node and a control node. The first node of the driving transistor 210 is coupled with the first node point N1. The second node of the driving transistor 210 is coupled with the second node point N2. The control node of the driving transistor 210 is coupled with the third node point N3. As shown in FIG. 2, the pixel circuit 110 further comprises a fourth node point N4 and a fifth node point N5, and the first node point N1 through the fifth node point N5 have a first node point voltage V1, a second node point voltage V2, a third node point voltage V3, a fourth node point voltage V4, and a fifth node point voltage V5, respectively.

The compensation circuit 220 is coupled with the first node point N1 and the third node point N3. The compensation circuit 220 is further configured to control the voltage level of the control node of the driving transistor 210, so that the driving transistor 210 is able to generate the driving current. The writing circuit 230 is configured to receive the first data signal Sd1 and the second data signal Sd2 from the driving line 120, and selectively provide the first data signal Sd1 and the second data signal Sd2 to the compensation circuit 220. It is worth mentioning that, when the compensation circuit 220 receives the first data signal Sd1, the compensation circuit 220 renders the first node point voltage V1 positively correlated with the absolute value of the threshold voltage of the driving transistor 210. As a result, the threshold voltage variation of the driving transistor 210 may be compensated by the following operations.

The emission control circuit 240 is configured to apply a system high voltage OVDD to the first node point N1 and the fourth node point N4 to reset the first node point voltage V1 and the fourth node point voltage V4, or to generate a voltage difference, capable of inducing the driving current, between the first node and the control node of the driving transistor 210. The reset circuit 250 is coupled with the second node point N2 and the third node point N3, and configured to reset the second node point voltage V2 and the third node point voltage V3.

The light emitting element 260 comprises a first node (e.g., the anode) and a second node (e.g., the cathode). The first node of the light emitting element 260 is configured to receive the driving current generated by the driving transistor 210. The second node of the light emitting element 260 is configured to receive the system low voltage OVSS. The light emitting element 260 generates corresponding luminance according to the magnitude of the received driving current. In practice, the light emitting element 260 may be realized with light-emitting components such as the organic light-emitting diode (OLED) or the micro light-emitting diode.

Specifically, the compensation circuit 220 comprises a first switch M1, a second switch M2, and a first capacitor C1. The first switch M1 comprises a first node, a second node, and a control node. The first node of the first switch M1 is coupled with the first node point N1. The second node of the first switch M1 is coupled with the fourth node point N4. The control node of the first switch M1 is configured to receive the first control signal Sc1. The second switch M2 comprises a first node, a second node, and a control node. The first node of the second switch M2 is coupled with the third node point N3. The second node of the second switch M2 is coupled with the fifth node point N5. The control node of the second switch M2 is configured to receive the second control signal Sc2. The first capacitor C1 is coupled between the fourth node point N4 and the fifth node point N5.

The writing circuit 230 comprises a third switch M3 and a fourth switch M4. The third switch M3 comprises a first node, a second node, and a control node. The first node of the third switch M3 is coupled with the fourth node point N4. The second node of the third switch M3 is coupled with the driving line 120. The control node of the third switch M3 is configured to receive the third control signal Sc3. The fourth switch M4 comprises a first node, a second node, and a control node. The first node of the fourth switch M4 is coupled with the fifth node point N5. The second node of the fourth switch M4 is coupled with the driving line 120. The control node of the fourth switch M4 is configured to receive the first control signal Sc1.

The emission control circuit 240 comprises a fifth switch M5 and a second capacitor C2. The fifth switch M5 comprises a first node, a second node, and a control node. The first node of the fifth switch M5 is configured to receive the system high voltage OVDD. The second node of the fifth switch M5 is coupled with the first node point N1. The control node of the fifth switch M5 is configured to receive the emission control signal Sem. The second capacitor C2 comprises a first node and a second node. The first node of the second capacitor C2 is configured to receive the system high voltage OVDD. The second node of the second capacitor C2 is coupled with the fourth node point N4.

The reset circuit 250 comprises a sixth switch M6 and a seventh switch M7. The sixth switch M6 comprises a first node, a second node, and a control node. The first node of the sixth switch M6 is coupled with the third node point N3. The second node of the sixth switch M6 is configured to receive the first reference voltage Vref1. The control node of the sixth switch M6 is configured to receive the first control signal Sc1. The seventh switch M7 comprises a first node, a second node, and a control node. The first node of the seventh switch M7 is configured to receive the second reference voltage Vref2. The second node of the seventh switch M7 is coupled with the second node point N2 and the first node of the light emitting element 260.

In practice, the first switch M1 through the seventh switch M7 may be realized with P-type thin-film transistors or other suitable sorts of P-type transistors. The first control signal Sc1, the second control signal Sc2, the third control signal Sc3, and the emission control signal Sem may be provided by the gate driver 104 of FIG. 1.

Figure 3:
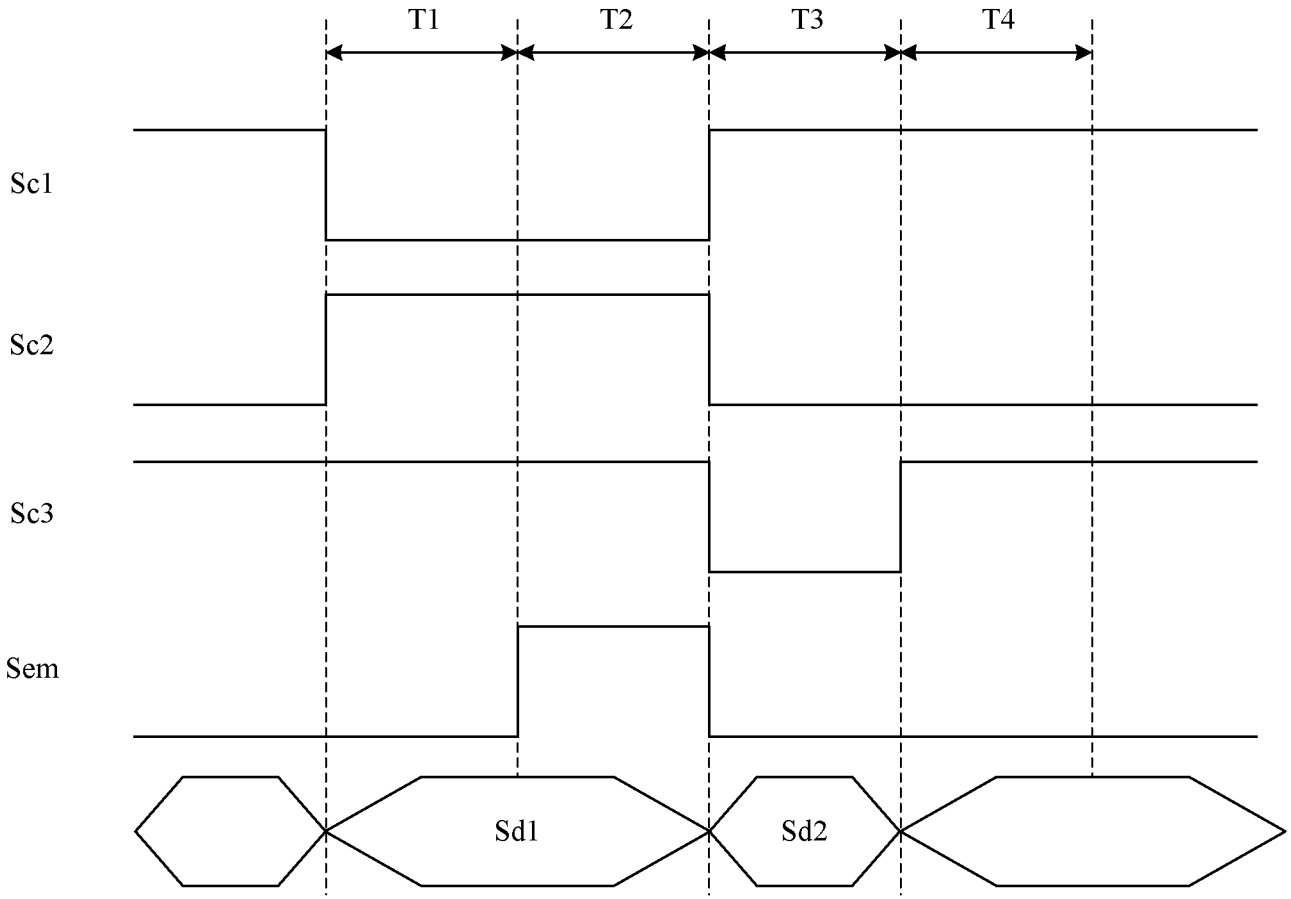
FIG. 3 is a timing diagram illustrating operations of the pixel circuit of FIG. 2.
Figure 4A:
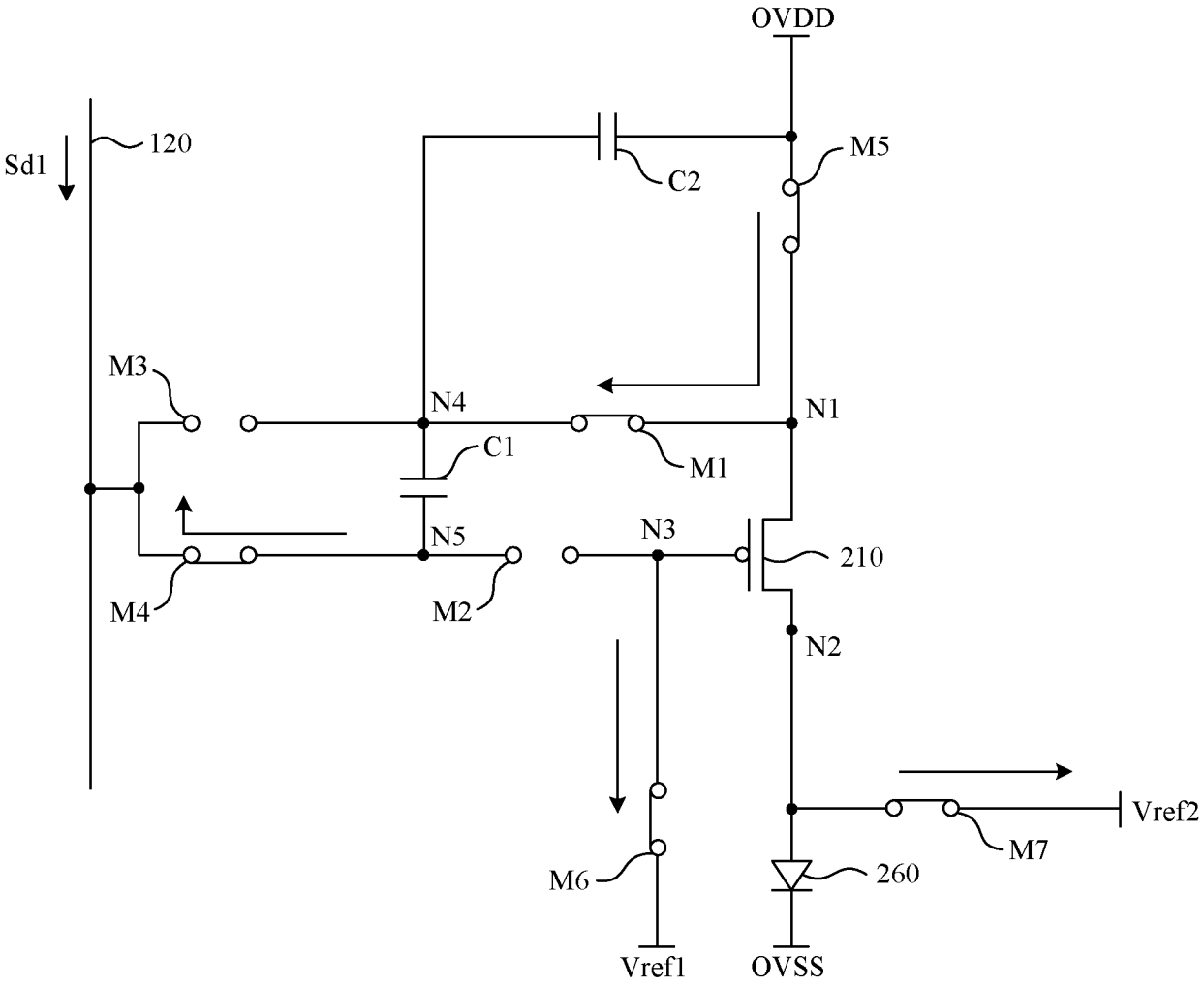
FIG. 4A is a schematic diagram of an equivalent circuit for illustrating the driving method of the pixel circuit of FIG. 2 in the reset stage.

FIG. 3 is a timing diagram illustrating operations of the pixel circuit 110 of FIG. 2. The operations of the pixel circuit 110 will be further described in the following by reference to FIGS. 2 and 3. As shown in FIG. 3, in the reset stage T1, the first control signal Sc1 and the emission control signal Sem have an enabling voltage level (e.g., the low voltage level), and the second control signal Sc2 and the third control signal Sc3 have a disabling voltage level (e.g., the high voltage level). Therefore, the first switch M1, the fourth switch M4, the fifth switch M5, the sixth switch M6, and the seventh switch M7 is conducted, and the second switch M2 and the third switch M3 is switched off. Therefore, the pixel circuit 110 is equivalent to the circuit shown in FIG. 4A.

In this situation, the system high voltage OVDD is transmitted through the fifth switch M5 to the first node point N1, and then transmitted through the first switch M1 to the fourth node point N4. Therefore, the first node point voltage V1 and the fourth node point voltage V4 is set to the system high voltage OVDD. The first reference voltage Vref1 is transmitted through the sixth switch M6 to the third node point N3. The second reference voltage Vref2 is transmitted through the seventh switch M7 to the second node point N2 and the first node of the light emitting element 260, so that the second node point voltage V2 and the third node point voltage V3 is set to the second reference voltage Vref2 and the first reference voltage Vref1, respectively. The driving line 120 provides the first data signal Sd1 to the pixel circuit 110, and the first data signal Sd1 would be transmitted through the fourth switch M4 to the fifth node point N5, so that the fifth node point voltage V5 is set to the voltage level of the first data signal Sd1.

In this embodiment, the second reference voltage Vref2 may be lower or equal to the system low voltage OVSS to render the light emitting element 260 remain in the switched-off status during the reset stage T1. As a result, erroneous illuminance is obviated, and the contrast ratio of the high-brightness display device 100 is increased.

Figure 4B:
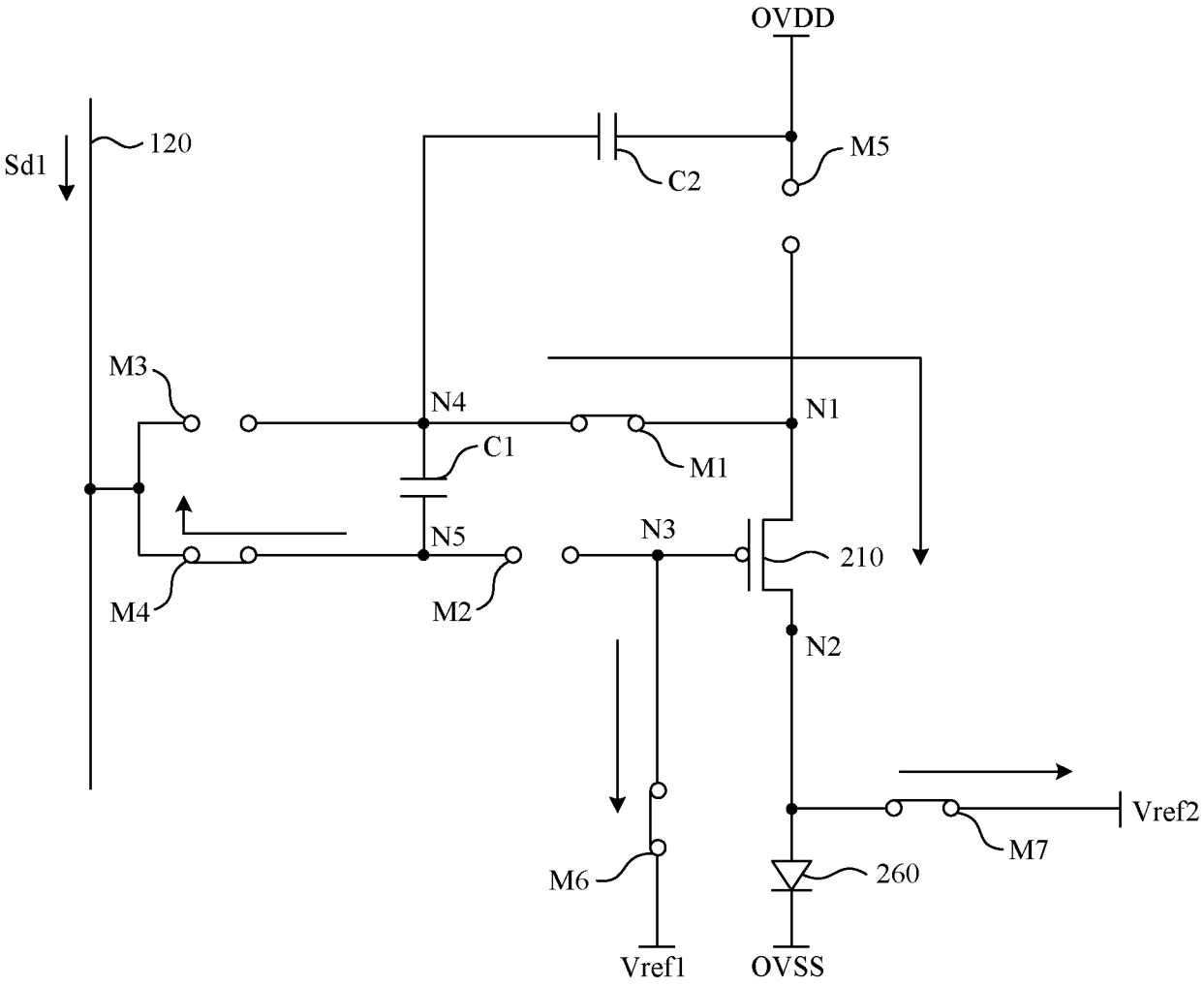
FIG. 4B is a schematic diagram of an equivalent circuit for illustrating the driving method of the pixel circuit of FIG. 2 in the compensation stage.

In the compensation stage T2, the first control signal Sc1 has the enabling voltage level, and the second control signal Sc2, the third control signal Sc3, and the emission control signal Sem have the disabling voltage level. Therefore, the first switch M1, the fourth switch M4, the sixth switch M6, and the seventh switch M7 is conducted, and the second switch M2, the third switch M3, and the fifth switch M5 is switched-off. As a result, the pixel circuit 110 is equivalent to the circuit shown in FIG. 4B.

In this situation, the third node point voltage V3 is maintained at the first reference voltage Vref1, and the driving line 120 continuously supplies the first data signal Sd1 to the pixel circuit 110 to keep the fifth node point voltage V5 at the voltage level of the first data signal Sd1. The first capacitor C1 discharges through the first switch M1, the driving transistor 210, and the seventh switch M7, and thus the fourth node point voltage V4 and the first node point voltage V1 are gradually decreased until the fourth node point voltage V4 and the first node point voltage V1 is equal to the voltage shown in formula (1):

$$V4=V1=Vref1+|Vth| \tag{1}$$

Vth is the threshold voltage of the driving transistor 210. With respect to formula (1), in compensation stage T2, the compensation circuit 220 renders the first node point voltage V1 and the fourth node point voltage V4 positively correlated with the absolute value of the threshold voltage of the driving transistor 210.

Figure 4C:
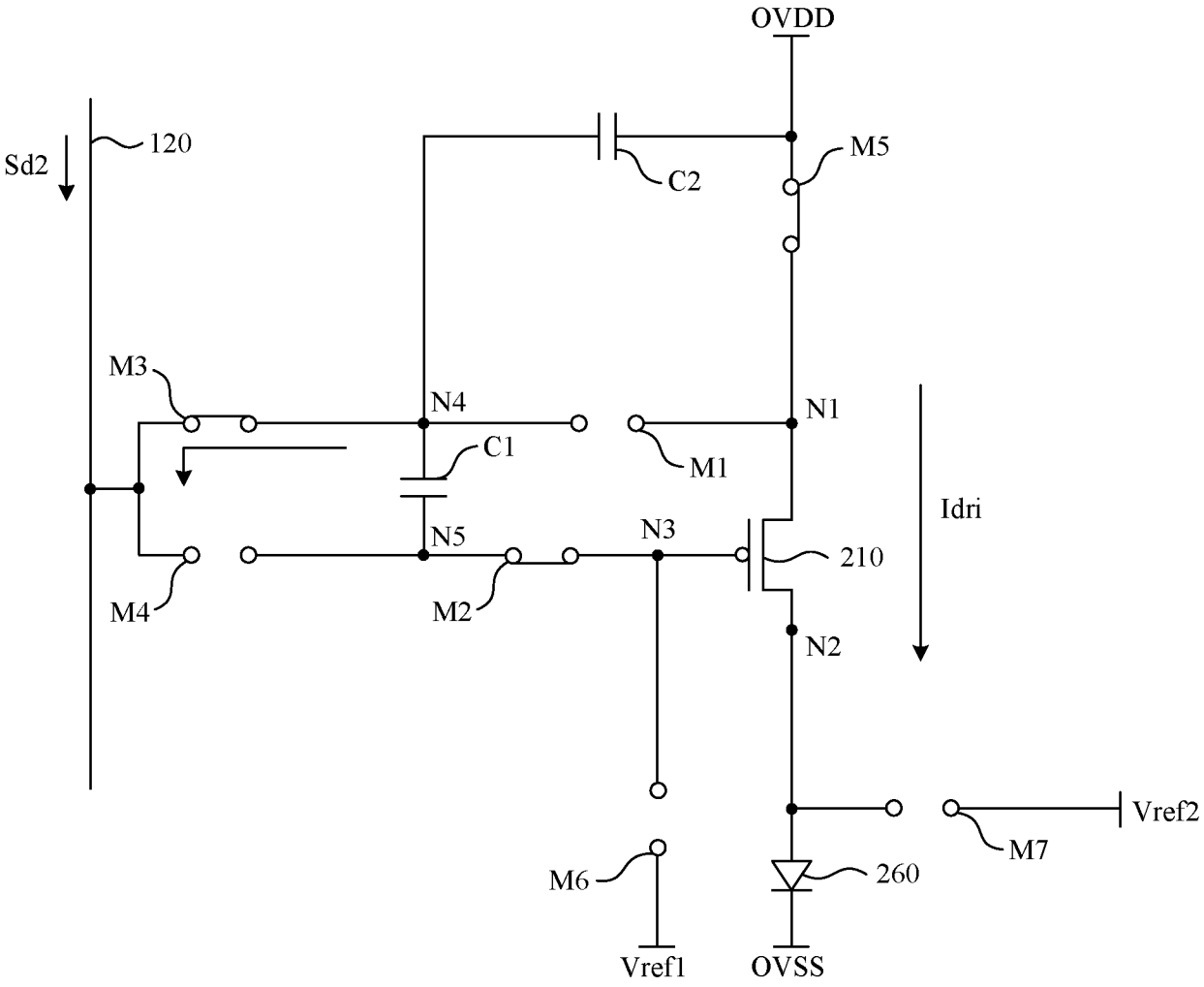
FIG. 4C is a schematic diagram of an equivalent circuit for illustrating the driving method of the pixel circuit of FIG. 2 in the writing stage.

Then, in the writing stage T3, the second control signal Sc2, the third control signal Sc3, and the emission control signal Sem have the enabling voltage level, and the first control signal Sc1 has the disabling voltage level. Therefore, the second switch M2, the third switch M3, and the fifth switch M5 is conducted, and the first switch M1, the fourth switch M4, the sixth switch M6, and the seventh switch M7 is switched off. As a result, the pixel circuit 110 is equivalent to the circuit shown in FIG. 4C.

In this situation, the system high voltage OVDD is transmitted through the fifth switch M5 to the first node point N1. The driving line 120 supplies the second data signal Sd2 to the pixel circuit 110, and the second data signal Sd2 is transmitted through the third switch M3 to the fourth node point N4. Therefore, the fourth node point voltage V4 is changed from the voltage of formula (1) to the voltage level of the second data signal Sd2. Because of the capacitor coupling effect of the first capacitor C1, the variation of the fourth node point voltage V4 is transmitted through the first capacitor C1 to the fifth node point N5. Since the fifth node point N5 is floating, the fifth node point voltage V5 is changed to the voltage shown in formula (2):

$$V5=Sd1=Sd2-Vref1-|Vth| \tag{2}$$

Since the second switch M2 is conducted and the capacitance of the first capacitor C1 is much greater than the capacitance of the control node capacitor of the driving transistor 210, the third node point voltage V3 is equal to the fifth node point voltage V5. As a result, the driving transistor 210 generates the driving current Idri according to the difference between the first node point voltage V1 and the third node point voltage V3. According to the current equation of the saturation region of the transistor, the magnitude of the driving current Idri is presented in the formula (3):

$$Idri=\tfrac{1}{2}k(OVDD-Sd1-Sd2+Vref1)^2 \tag{3}$$

K is the product of the carrier mobility, the gate oxide capacitance per unit area, and the width length ratio of the driving transistor 210. As can be appreciate from the formula (3), the magnitude of the driving current Idri is not related to the threshold voltage of the driving transistor 210. Accordingly, the pixel circuit 110 applying the operation shown in FIG. 3 can effectively compensate the variation of the threshold voltage of the driving transistor 210.

Figure 4D:
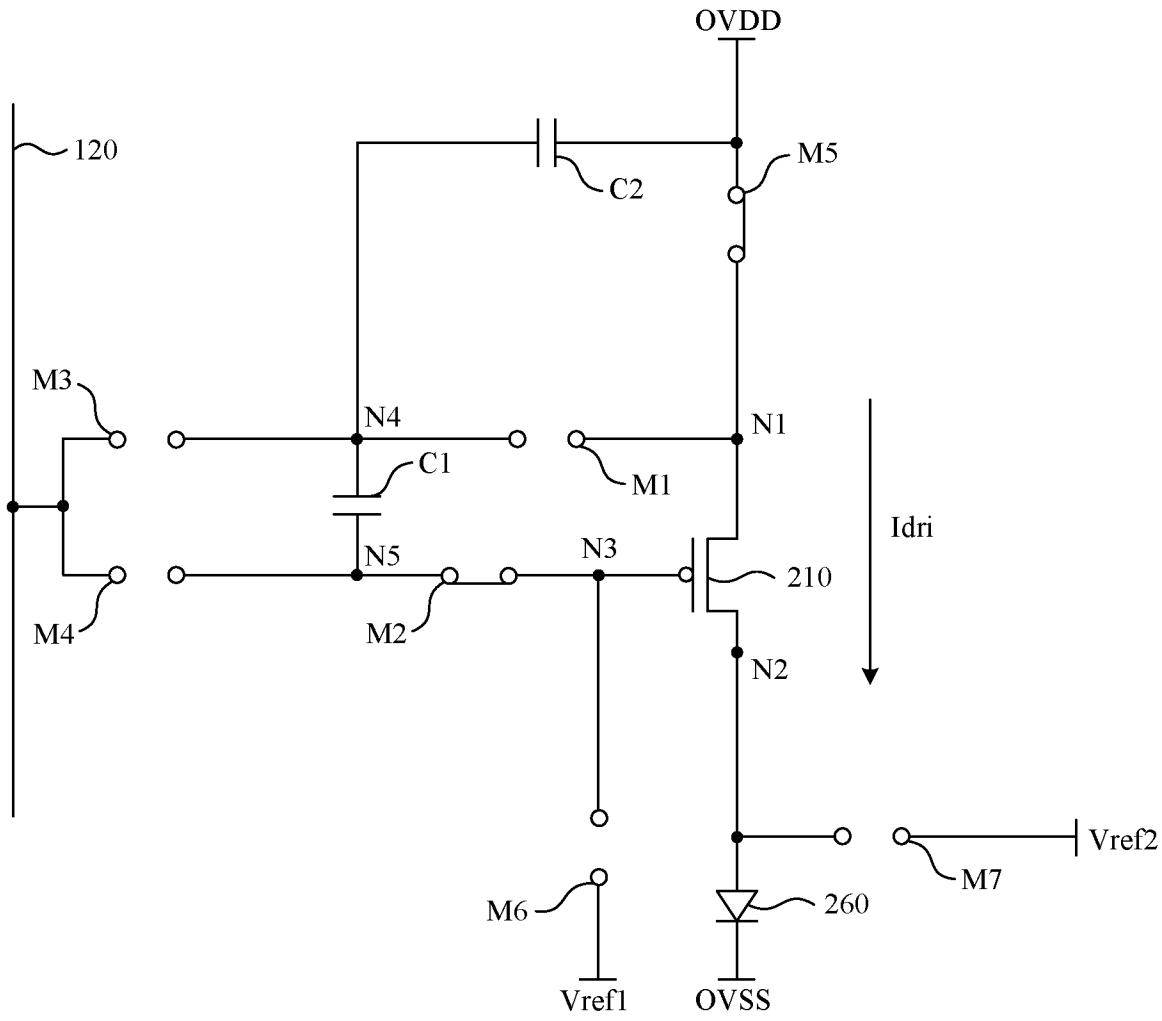
FIG. 4D is a schematic diagram of an equivalent circuit for illustrating the driving method of the pixel circuit of FIG. 2 in the emission stage.

In the emission stage T4, the second control signal Sc2 and the emission control signal Sem have the enabling voltage level, and the first control signal Sc1 and the third control signal Sc3 have the disabling voltage level. Therefore, the second switch M2 and the fifth switch M5 is conducted, and the first switch M1, the third switch M3, the fourth switch M4, the sixth switch M6, and the seventh switch M7 is switched off. As a result, the pixel circuit 110 is equivalent to the circuit shown in FIG. 4D.

During this stage, the magnitude of the driving current Idri may also be calculated by using the formula (3). Since the third node point N3 is floating, the variation of the system high voltage OVDD is transmitted through the first capacitor C1 and the second capacitor C2 to the third node point N3. Therefore, when the system high voltage OVDD varies, the voltage difference between the first node and the control node of the driving transistor 210 can still remain at a constant value, so that the magnitude of the driving current Idri is also constant. As a result, the high-brightness display device 100 is prevented from suffering the flicker phenomenon.

As can be appreciate from the forgoing descriptions, the high-brightness display device 100 may be selectively operated in the normal mode or the high-brightness mode. When the high-brightness display device 100 is operated in the normal mode, one of the first data signal Sd1 and the second data signal Sd2 is configured to be a DC signal having a voltage level equal to the first reference voltage Vref1, while another one of the first data signal Sd1 and the second data signal Sd2 is configured to be an AC signal.

In one embodiment, the first data signal Sd1 is configured to be the DC signal, while the second data signal Sd2 is configured to be the AC signal. The voltage level of the first data signal Sd1 is the same as the first reference voltage Vref1. Therefore, in the writing stage T3 or the emission stage T4, the magnitude of the driving current Idri may be calculated by using the formula (4) instead of using the formula (3):

$$Idri=\tfrac{1}{2}k(OVDD-Sd2)^2 \quad (4)$$

In another embodiment, the second data signal Sd2 is configured to be the DC signal, while the first data signal Sd1 is configured to be the AC signal. The voltage level of the second data signal Sd2 is the same as the first reference voltage Vref1. Therefore, in the writing stage T3 or the emission stage T4, the magnitude of the driving current Idri may be calculated by using the formula (5) instead of using the formula (3):

$$Idri=\tfrac{1}{2}k(OVDD-Sd1)^2 \quad (5)$$

When the high-brightness display device 100 is operated in the high-brightness mode, the first data signal Sd1 and the second data signal Sd2 are both configured to be the AC signal, and the voltage level of one of the first data signal Sd1 and the second data signal Sd2 is lower than the first reference voltage Vref1. Therefore, the magnitude of the driving current Idri may be calculated by using the formula (3). The magnitude of the driving current Idri is negatively correlated with a sum of the voltage level of the first data signal Sd1 and the voltage level of the second data signal Sd2 received by the pixel circuit 110. As can be appreciated from the formulas (3) through (5), the maximum current value of the driving current Idri generated in the high-brightness mode is larger than the maximum current value of the driving current Idri generated in the normal mode. As a result, the pixel circuit 110 is capable of emitting higher illuminance during the high-brightness mode.

In one embodiment, the fifth switch M5 is maintained in the switched-off status in the writing stage T3, and switched to the conducted status until the emission stage T4 to prevent the driving current Idri from the disturbance caused by the change of the third node point voltage V3 in the writing stage T3. Accordingly, the picture quality of the high-brightness display device 100 can be further improved.

Figure 5:
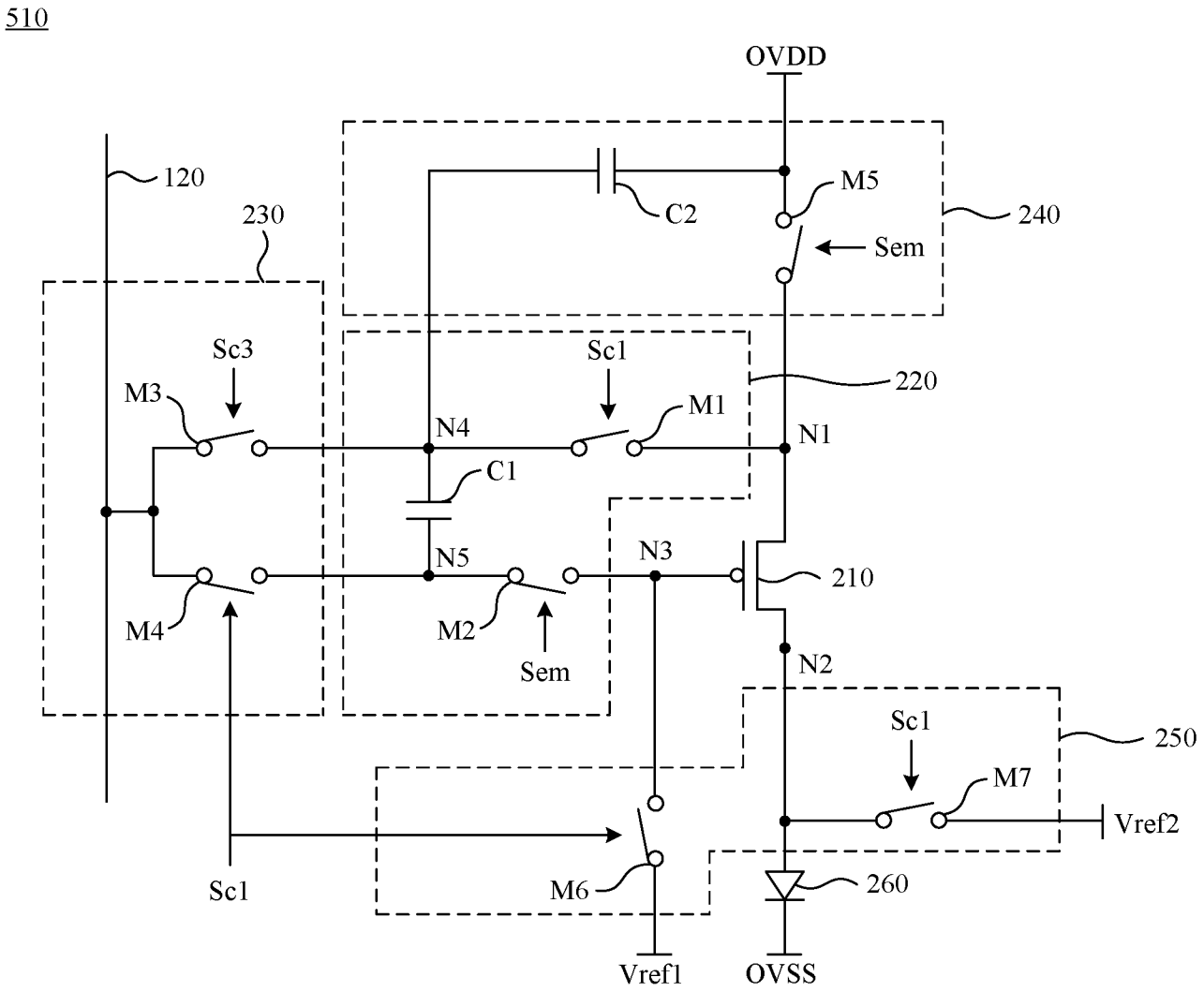
FIG. 5 is a schematic diagram of a pixel circuit according to one embodiment of the present disclosure.

FIG. 5 is a schematic diagram of a pixel circuit 510 according to one embodiment of the present disclosure. The pixel circuit 510 is suitable for the high-brightness display device 100, and is similar to the pixel circuit 110. The difference is that the pixel circuit 510 needs not to receive the third control signal Sc3, and the control node of the second switch M2 is configured to receive the emission control signal Sem. Thus, the signal complexity and the total circuit area are both mitigated. In the reset stage T1, the second switch M2 is conducted, so that the third node point voltage V3 and the fifth node point voltage V5 are between the voltage level of the first data signal Sd1 and the first reference voltage Vref1. The foregoing descriptions regarding the implementations, connections, operations, and related advantages of other corresponding functional blocks and components in the pixel circuit 110 are also applicable to the pixel circuit 510. For the sake of brevity, those descriptions will not be repeated here.

Figure 6:
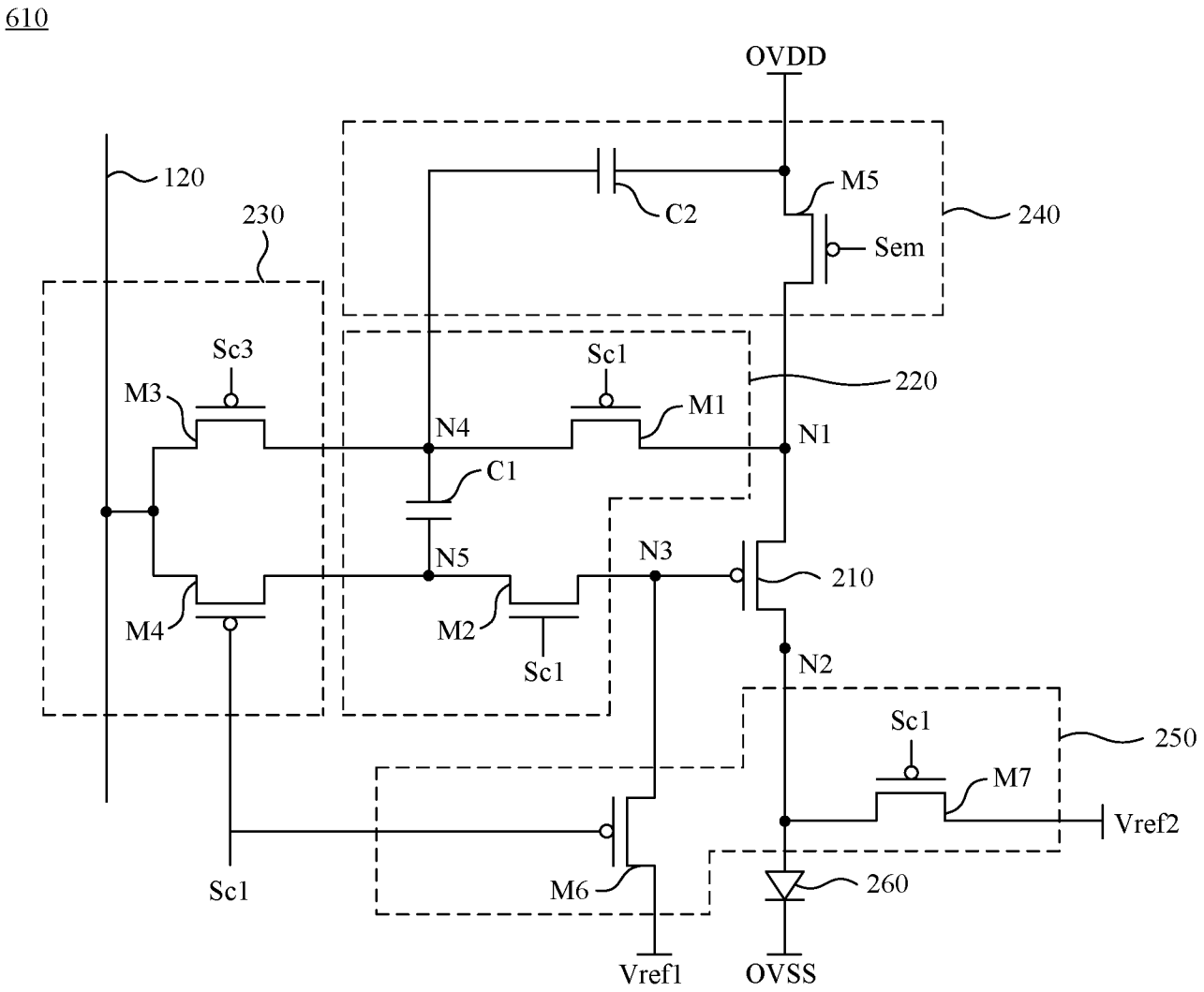
FIG. 6 is a schematic diagram of the pixel circuit according to one embodiment of the present disclosure.

FIG. 6 is a schematic diagram of the pixel circuit 610 according to one embodiment of the present disclosure. The pixel circuit 610 is suitable for the high-brightness display device 100, and is similar to the pixel circuit 110. The difference is that the pixel circuit 610 needs not to receive the third control signal Sc3 to mitigate the signal complexity and the total circuit area. The control node of the second switch M2 is configured to receive the first control signal Sc1, and the second switch M2 is realized with the N-type transistor. In the aforementioned embodiment of FIG. 3, the first control signal Sc1 and the third control signal Sc3 are in inverse relation to each other. Therefore, the operation conducted by the second switch M2 of the pixel circuit 610 is similar to the operation conducted by the second switch M2 of the pixel circuit 110. The foregoing descriptions regarding the implementations, connections, operations, and related advantages of other corresponding functional blocks and components in the pixel circuit 110 are also applicable to the pixel circuit 610. For the sake of brevity, those descriptions will not be repeated here.

Figure 7:
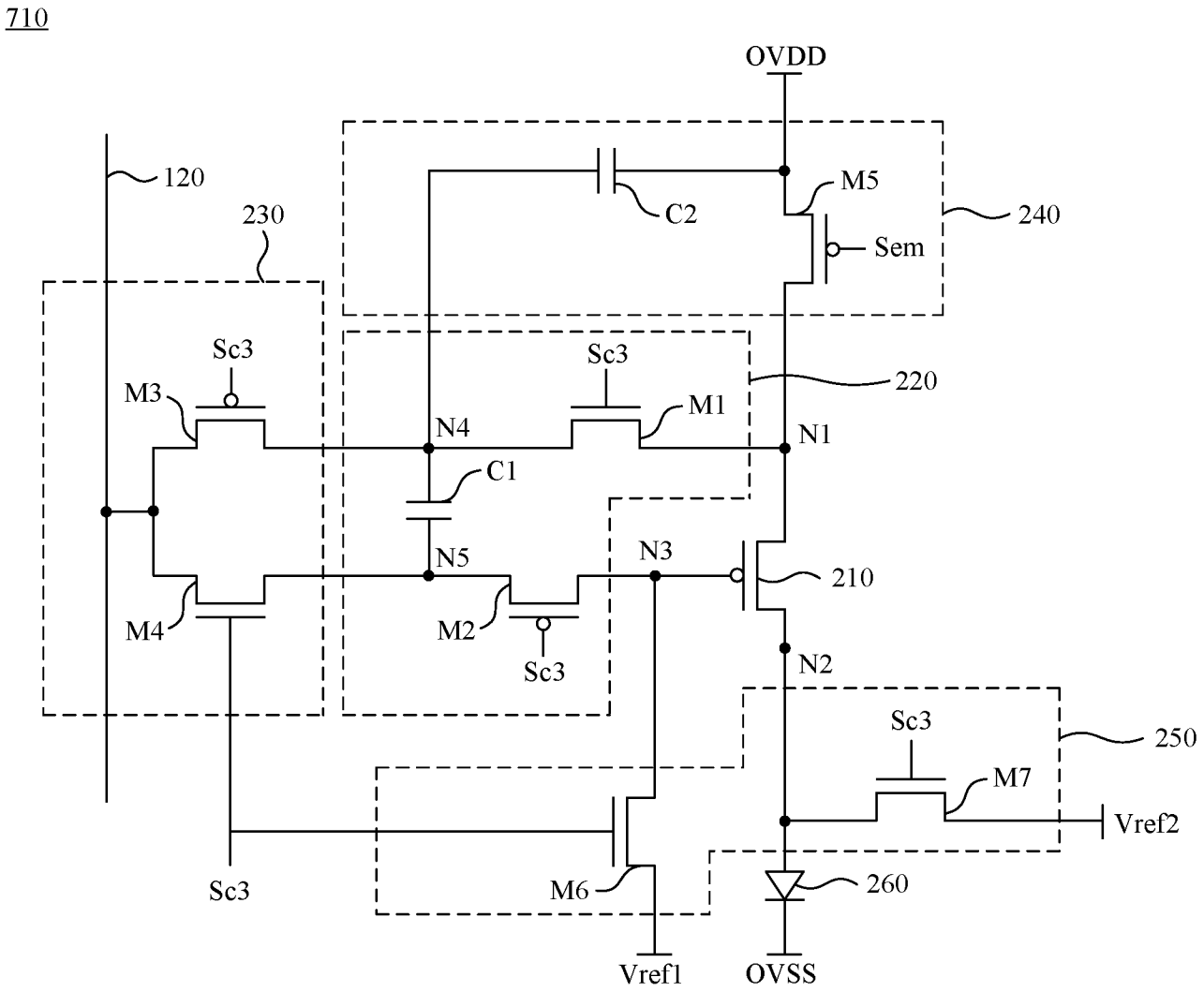
FIG. 7 is a schematic diagram of a pixel circuit according to one embodiment of the present disclosure.

FIG. 7 is a schematic diagram of a pixel circuit 710 according to one embodiment of the present disclosure. The pixel circuit 710 is suitable for the high-brightness display device 100, and is similar to the pixel circuit 110. The =difference is that the pixel circuit 710 needs not to receive the first control signal Sc1 to mitigate the signal complexity and the total circuit area. The first switch M1, the fourth switch M4, the sixth switch M6, and the seventh switch M7 are realized with the N-type transistors, and the control nodes thereof are all configured to receive the third control signal Sc3. In the aforementioned embodiment of FIG. 3, the first control signal Sc1 and the third control signal Sc3 are in inverse relation to each other. Therefore, the operations conducted by the first switch M1, the fourth switch M4, the sixth switch M6, and the seventh switch M7 of the pixel circuit 710 are similar to the operations conducted by the first switch M1, the fourth switch M4, the sixth switch M6, and the seventh switch M7 of the pixel circuit 110, respectively. The foregoing descriptions regarding the implementations, connections, operations, and related advantages of other corresponding functional blocks and components in the pixel circuit 110 are also applicable to the pixel circuit 710. For the sake of brevity, those descriptions will not be repeated here.

As can be appreciated for the foregoing descriptions, the high-brightness display panel 100 and the pixel circuits 110, 510, 610, and 710 are capable of adaptively being operated in the normal mode or the high-brightness mode, so as to enable the wearable device to provide clear pictures in the high-brightness environment.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A pixel circuit, comprising:

a driving transistor, comprising a first node, a second node, and a control node, wherein the first node of the driving transistor is coupled with a first node point, and the second node of the driving transistor is coupled with a second node point, and the control node of the driving transistor is coupled with a third node point;

a compensation circuit, coupled with the first node point and the third node point, and configured to control the driving transistor to generate a driving current;

a writing circuit, configured to receive a first data signal and a second data signal from a driving line, and to selectively provide the first data signal and the second data signal to the compensation circuit, wherein when the compensation circuit receives the first data signal, the compensation circuit renders a first node point voltage of the first node point positively correlated with an absolute value of a threshold voltage of the driving transistor;

an emission control circuit, configured to apply a system high voltage to the first node point;

a reset circuit, coupled with the second node point and the third node point, and configured to reset a second node point voltage of the second node point and a third node point voltage of the third node point; and a light emitting element, configured to generate corresponding luminance according to the driving current, wherein the first data signal and the second data signal are AC signals, and magnitude of the driving current is negatively correlated with a sum of a voltage level of the first data signal and a voltage level of the second data signal received by the pixel circuit.

2. The pixel circuit of claim 1, wherein the compensation circuit comprises:

a first switch, comprising a first node, a second node, and a control node, wherein the first node of the first switch is coupled with the first node point, the second node of the first switch is coupled with a fourth node point, and the control node of the first switch is configured to receive a first control signal;

a second switch, comprising a first node, a second node, and a control node, wherein the first node of the second switch is coupled with the third node point, the second node of the second switch is coupled with a fifth node point, and a control node of the second switch is configured to receive a second control signal; and a first capacitor element, coupled with between the fourth node point and the fifth node point.

3. The pixel circuit of claim 2, wherein the writing circuit comprises:

a third switch, comprising a first node, a second node, and a control node, wherein the first node of the third switch is coupled with the fourth node point, the second node of the third switch is coupled with the driving line, and the control node of the third switch is configured to receive a third control signal; and a fourth switch, comprising a first node, a second node, and a control node, wherein the first node of the fourth switch is coupled with the fifth node point, the second node of the fourth switch is coupled with the driving line, and the control node of the fourth switch is configured to receive the first control signal.

4. The pixel circuit of claim 3, wherein the emission control circuit comprises:

a fifth switch, comprising a first node, a second node, and a control node, wherein the first node of the fifth switch is configured to receive the system high voltage, the second node of the fifth switch is coupled with the first node point, and the control node of the fifth switch is configured to receive an emission control signal; and a second capacitor element, comprising a first node and a second node, wherein the first node of the second capacitor element is configured to receive the system high voltage, the second node of the second capacitor element is coupled with the fourth node point.

5. The pixel circuit of claim 4, wherein during a reset stage, the first control signal and the emission control signal have an enabling voltage level, and the second control signal and the third control signal having a disabling voltage level, wherein during a compensation stage, the first control signal has the enabling voltage level, and the second control signal, the third control signal, and the emission control signal have the disabling voltage level, wherein during a writing stage, the second control signal, the third control signal, and the emission control signal have the enabling voltage level, and the first control signal has the disabling voltage level, wherein during a emission stage, the second control signal and the emission control signal have the enabling voltage level, and the first control signal and the third control signal have the disabling voltage level.

6. The pixel circuit of claim 2, wherein the reset circuit comprises:

a sixth switch, comprising a first node, a second node, and a control node, wherein the first node of the sixth switch is coupled with the third node point, the second node of the sixth switch is configured to receive a first reference voltage, and the control node of the sixth switch is configured to receive the first control signal; and a seventh switch, comprising a first node, a second node, and a control node, the first node of the seventh switch is configured to receive a second reference voltage, the second node of the seventh switch is coupled with the second node point and a first node of the light emitting element.

7. The pixel circuit of claim 1, wherein the compensation circuit comprises:

a first switch, comprising a first node, a second node, and a control node, wherein the first node of the first switch is coupled with the first node point, the second node of the first switch is coupled with a fourth node point, and the control node of the first switch is configured to receive a first control signal;

a second switch, comprising a first node, a second node, and a control node, wherein the first node of the second switch is coupled with the third node point, the second node of the second switch is coupled with a fifth node point, and the control node of the second switch is configured to receive a emission control signal; and a first capacitor element, coupled between the fourth node point and the fifth node point;

wherein the emission control circuit comprises:

a third switch, comprising a first node, a second node, and a control node, wherein the first node of the third switch is configured to receive the system high voltage, the second node of the third switch is coupled with the first node point, and the control node of the third switch is configured to receive the emission control signal; and a second capacitor element, comprising a first node and a second node, wherein the first node of the second capacitor element is configured to receive the system high voltage, and the second node of the second capacitor element is coupled with the fourth node point.

8. The pixel circuit of claim 1, wherein the compensation circuit comprises:

a P-type transistor, comprising a first node, a second node, and a control node, wherein the first node of the P-type transistor is coupled with the first node point, the second node of the P-type transistor is coupled with a fourth node point, and the control node of the P-type transistor is configured to receive a first control signal;

an N-type transistor, comprising a first node, a second node, and a control node, the first node of the N-type transistor is coupled with the third node point, the second node of the N-type transistor is coupled with a fifth node point, and the control node of the N-type transistor is configured to receive the first control signal; and a first capacitor element, coupled between the fourth node point and the fifth node point.

9. A high-brightness display device, comprising:

a plurality of pixel circuits; and a driving line, configured to provide a first data signal and a second data signal to a column of pixel circuits of the plurality of pixel circuits;

wherein when the high-brightness display device is operated in a normal mode, the first data signal is a DC signal and the second data signal is an AC signal, and a driving current of a pixel circuit of the column of pixel circuits has a first maximum current value, wherein when the high-brightness display device is operated in a high-brightness mode, the first data signal and the second data signal are both the AC signals, and the driving current of the pixel circuit have a second maximum current value, and wherein the second maximum current value is larger than the first maximum current value.

10. The high-brightness display device of claim 9, wherein the pixel circuit is configured to receive a first reference voltage from the high-brightness display device, wherein when the high-brightness display device is operated in the normal mode, a voltage level of the first data signal is equal to the first reference voltage, wherein when the high-brightness display device is operated in the high-brightness mode, one of the voltage level of the first data signal and a voltage level of the second data signal is lower than the first reference voltage.

11. The high-brightness display device of claim 9, wherein the pixel circuit comprises:

a driving transistor, comprising a first node, a second node, and a control node, wherein the first node of the driving transistor is coupled with a first node point, the second node of the driving transistor is coupled with a second node point, and the control node of the driving transistor is coupled with a third node point;

a compensation circuit, coupled with the first node point and the third node point, and configured to control the driving transistor to generate the driving current;

a writing circuit, configured to selectively provide the first data signal and the second data signal to the compensation circuit, wherein when the compensation circuit receives the first data signal, the compensation circuit render a first node point voltage of the first node point positively correlated with an absolute value of a threshold voltage of the driving transistor;

an emission control circuit, configured apply a system high voltage to the first node point;

a reset circuit, coupled with the second node point and the third node point, configured to reset a second node point voltage of the second node point and a third node point voltage of the third node point; and a light emitting element, configured to generate corresponding luminance according to the driving current.

12. The high-brightness display device of claim 11, wherein when the high-brightness display device is operated in the high-brightness mode, and the magnitude of the driving current is negatively correlated with a sum of the voltage level of the first data signal and the voltage level of the second data signal received by the pixel circuit.

13. The high-brightness display device of claim 11, wherein the compensation circuit comprises:

a first switch, comprising a first node, a second node, and a control node, wherein the first node of the first switch is coupled with the first node point, the second node of the first switch is coupled with a fourth node point, and the control node of the first switch is configured to receive a first control signal;

a second switch, comprising a first node, a second node, and a control node, wherein the first node of the second switch is coupled with third node point, the second node of the second switch is coupled with a fifth node point, and the control node of the second switch is configured to receive a second control signal; and a first capacitor element, coupled between the fourth node point and the fifth node point.

14. The high-brightness display device of claim 13, wherein the writing circuit comprises:

a third switch, comprising a first node, a second node, and a control node, wherein the first node of the third switch is coupled with the fourth node point, the second node of the third switch is coupled with the driving line, and the control node of the third switch is configured to receive a third control signal; and a fourth switch, comprising a first node, a second node, and a control node, wherein the first node of the fourth switch is coupled with the fifth node point, the second node of the fourth switch is coupled with the driving line, and the control node of the fourth switch is configured to receive the first control signal.

15. The high-brightness display device of claim 14, wherein the emission control circuit comprises:

a fifth switch, comprising a first node, a second node, and a control node, wherein the first node of the fifth switch is configured to receive the system high voltage, the second node of the fifth switch is coupled with the first node point, and the control node of the fifth switch is configured to receive a emission control signal; and a second capacitor element, comprising a first node and a second node, wherein the first node of the second capacitor element is configured to receive the system high voltage, and the second node of the second capacitor element is coupled with the fourth node point.

16. The high-brightness display device of claim 15, wherein during a reset stage, the first control signal and the emission control signal have an enabling voltage level, and the second control signal and the third control signal having a disabling voltage level, wherein during a compensation stage, the first control signal has the enabling voltage level, and the second control signal, the third control signal, and the emission control signal have the disabling voltage level, wherein during a writing stage, the first control signal has the disabling voltage level, and the second control signal, the third control signal, and the emission control signal have the enabling voltage level, wherein during an emission stage, the second control signal and the emission control signal have the enabling voltage level, and the first control signal and the third control signal have the disabling voltage level.

17. The high-brightness display device of claim 13, wherein the reset circuit comprises:

a sixth switch, comprising a first node, a second node, and a control node, wherein the first node of the sixth switch is coupled with the third node point, the second node of the sixth switch is configured to receive the first reference voltage, and the control node of the sixth switch is configured to receive the first control signal; and a seventh switch, comprising a first node, a second node, and a control node, wherein the first node of the seventh switch is configured to receive a second reference voltage, and the second node of the seventh switch is coupled with the second node point and a first node of the light emitting element.

18. The high-brightness display device of claim 11, wherein the compensation circuit comprises:

a first switch, comprising a first node, a second node, and a control node, wherein the first node of the first switch is coupled with first node point, the second node of the first switch is coupled with a fourth node point, the control node of the first switch is configured to receive a first control signal;

a second switch, comprising a first node, a second node, and a control node, wherein the first node of the second switch is coupled with the third node point, the second node of the second switch is coupled with a fifth node point, and the control node of the second switch is configured to receive the a emission control signal; and a first capacitor element, coupled between the fourth node point and the fifth node point:

wherein the emission control circuit comprises:

a third switch, comprising a first node, a second node, and a control node, wherein the first node of the third switch is configured to receive the system high voltage, the second node of the third switch is coupled with first node point, and the control node of the third switch is configured to receive the emission control signal; and a second capacitor element, comprising a first node and a second node, wherein the first node of the second capacitor element is configured to receive the system high voltage, and the second node of the second capacitor element is coupled with the fourth node point.

19. The high-brightness display device of claim 11, wherein the compensation circuit comprises:

a P-type transistor, comprising a first node, a second node, and a control node, wherein the first node of the P-type transistor is coupled with the first node point, the second node of the P-type transistor is coupled with a fourth node point, and the control node of the P-type transistor is configured to receive a first control signal;

an N-type transistor, comprising a first node, a second node, and a control node, the first node of the N-type transistor is coupled with the third node point, the second node of the N-type transistor is coupled with a fifth node point, and the control node of the N-type transistor is configured to receive the first control signal; and a first capacitor element, coupled between the fourth node point and the fifth node point.

* * * * *